US006763810B1

(12) United States Patent
Jones

(10) Patent No.: US 6,763,810 B1
(45) Date of Patent: Jul. 20, 2004

(54) MEANS FOR OPTIMIZING UNIT INJECTORS FOR IMPROVED EMISSIONS/ FUEL-ECONOMY

(75) Inventor: Jerry A. Jones, Ravenna, OH (US)

(73) Assignee: Alfred J. Buescher, Shaker Heights, OH (US)

( * ) Notice: Subject to any disclaimer, the term of this patent is extended or adjusted under 35 U.S.C. 154(b) by 0 days.

(21) Appl. No.: 10/431,484

(22) Filed: May 7, 2003

(51) Int. Cl.[7] ..... F02M 37/04
(52) U.S. Cl. ..... 123/500; 123/300
(58) Field of Search ..... 123/500, 501, 123/449, 495, 299, 300; 73/117.2, 117.3, 119 A; 239/88–96; 417/499

(56) References Cited

U.S. PATENT DOCUMENTS 5,396,871 A * 3/1995 Faupel et al. ..... 123/500
5,487,651 A * 1/1996 Guentert et al. ..... 417/499
5,638,793 A * 6/1997 Rapp et al. ..... 123/500
5,708,201 A * 1/1998 Kaub ..... 73/119 A
6,032,641 A * 3/2000 Aketa et al. ..... 123/299
6,321,723 B1 * 11/2001 Merkle et al. ..... 123/500

* cited by examiner

*Primary Examiner*—Carl S. Miller
(74) *Attorney, Agent, or Firm*—Pearne & Gordon LLP

(57) ABSTRACT

A novel injection-pump plunger used in a unit injector for an EMD-type diesel engine has its upper (cut-off) control edge shaped to retard start of injection at full power from what it is with standard plungers, and to provide in a straight-line manner a relatively small increase in retardation from full load to idle. In a preferred form, the plunger has one or more steps in its upper (cut-off) control edge, the step or steps being formed between adjacent segments of the edge that are associated with different load points. A method of improving emissions/fuel-economy of EMD diesel engines comprises using prototype injection-pump plungers shaped within certain parameters, assessing their performance, selecting new patterns of timing based on the assessment, making new prototype plungers and assessing them, and repeating the steps of selecting, making and assessing if and as required until an assessment indicates compliance with applicable performance standards.

8 Claims, 3 Drawing Sheets

MEANS FOR OPTIMIZING UNIT INJECTORS FOR IMPROVED EMISSIONS/ FUEL-ECONOMY

FIELD OF THE INVENTION

This invention relates to diesel fuel injectors of the mechanical port-closing and spill type as used in various models of EMD locomotive, marine and power generation engines, and to components and means related to such injectors. These injectors are often referred to a "unit injectors" because both injection pump and nozzle are combined in a single unit.

BACKGROUND OF THE INVENTION

Mechanical injectors used in EMD engines are characterized by a fuel delivery system comprising, together with other parts, a plunger and bushing assembly having two ports in the bushing side wall, axially and diametrically spaced from each other. When the upper or "fill" port is completely covered or "cut off" by an upper control edge of the plunger during the down stroke of the plunger, delivery of high-pressure fuel to the nozzle begins. When, during the continued downward movement of the plunger, the lower or "spill" port starts to be uncovered by the plunger's lower control edge, fuel is spilled to low-pressure areas of the system and thereby drops to fuel supply pressure, and fuel delivery stops.

Mechanical injectors presently used in EMD engines employ both variable start of injection and variable end of injection relative to engine top dead center over the operating load range of the engine. The reason for using this timing and fuel control relationship dates back many years to when locomotive engine injectors were designed to reduce objectionable engine knocking at part load and idle operation. Knocking was particularly objectionable when locomotives idled in railroad stations. To address the problem, the upper control edge of the injector's pump plunger was given a constant helix angle so as to increase the degree of retardation as a straight line, inverse function of engine load as the latter decreased from full load all the way down to idle. The helix angle was relatively high, and correspondingly the increase in retardation over the range was also relatively high.

A disadvantage of this arrangement is high levels of nitrous oxide (NOx) production when the engine operates at full load or at close to full load. Another disadvantage is higher than normal fuel usage when idling or operating at part load because of the relatively high retardation of the start of injection at such load settings. Nevertheless, in the context of the prevailing engine requirements of many years ago, the arrangement performed quite well. At that time exhaust emissions, except for smoke, were not a concern and were not considered in optimizing the overall performance of the engine.

With today's environmental concerns, exhaust emissions become a dominant factor. Oxides of nitrogen are today the emissions constituent of greatest concern, and many means have been devised to reduce it to meet EPA's most stringent requirements, while at the same time maintaining acceptable fuel economy. These improvements involve complex design modifications such as electronic control of injection timing and fuel output, pilot injection, or injection rate shaping. All these improvements produce quite beneficial emissions reductions, but they require replacement of complete injectors with costly injector modifications.

BRIEF DESCRIPTION OF THE INVENTION

The present invention provides simple relatively low cost means to reduce oxides of nitrogen in the higher load operating range of the engine, and to achieve compliance with current emissions standards in respect of both NOx and particulates when emissions at the various load points are properly rated as prescribed by current EPA regulations, while at the same time providing acceptable fuel efficiency.

In an article-of-manufacture aspect, the invention involves plungers having one or more steps formed in their upper (cut-off) control edge between adjacent segments of the edge that are associated with adjacent load positions and are of 0 degrees helix angle, as more fully described below. Also, the upper port-closing control edge may be shaped to retard start of injection at full power from what it is with standard plungers; it may also be shaped to provide a smaller increase in retardation from full load to idle as compared to standard plungers, and to do so in a non-straight-line manner.

In a method aspect, the invention involves the concept of replacing the standard plungers of EMD-type injectors with prototype plungers shaped as described in the preceding paragraph, then assessing omissions/fuel-economy performance associated with the prototype plungers over all load points when operating in otherwise standard EMD injectors, then selecting a new pattern of timings as indicated by the assessment, making new prototype plungers and assessing them, repeating the steps of selecting, making and assessing if and as required until an assessment indicates compliance of the newest prototype plunger with applicable performance standards, and thereafter using replacement plungers having the form of the complying prototype in the standard injectors.

The prior art does include plungers, intended for use in EMD-type injectors, whose upper control edges are shaped such that start of injection is retarded at full power from what it is with standard plungers, but such plungers do not provide any change in retardation from full load to idle and have a poor overall emissions performance when used as substitutes for standard plungers in EMD type injectors.

BRIEF DESCRIPTION OF THE DRAWINGS

FIG. 1 also shows a broken-away associated section of the wall of the cylinder head of an EMD-type engine in which the injector is clamped by suitable clamping means (not shown).

FIG. 5 is a view similar to FIGS. 3 and 4, but showing the control edges and fill and spill ports of another substitute plunger made according to the invention for substitution in another standard EMD-type unit injector used in another standard EMD engine that is a variant of the design of EMD engine that FIGS. 1–4 relate to.

DETAILED DESCRIPTION OF THE INVENTION

Figures 1, 2:
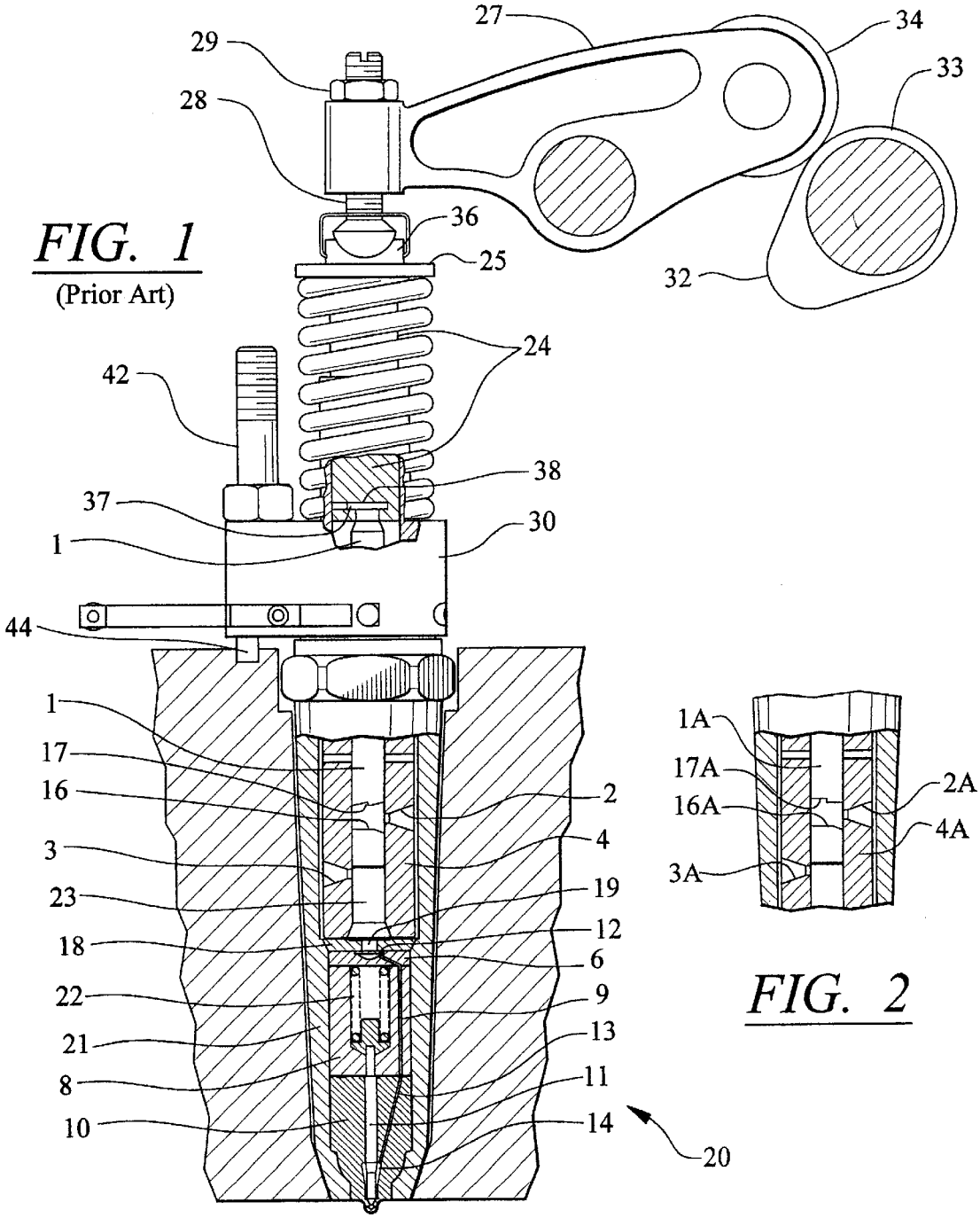
FIG. 1 (Prior Art)
FIG. 1 is a partially broken-away elevation view of a standard EMD-type unit injector, together with the associated drive linkage that powers the injector's standard pump plunger, which is also shown in the figure.
FIG. 2 is a partially broken-away view of part of the injector seen in FIG. 1 combined with a substitute plunger made according to the invention.

As indicated at the outset, the invention is applicable to fuel injectors used in EMD marine and power generation engines, as well as locomotive engines. All these several applications of EMD engines are broadly similar in construction and operation. In order that the invention may be most readily understood in context, and by way of example, a typical diesel locomotive EMD-type fuel injector of a standard design will first be described in some detail. Such an injector is shown in cross-section in FIG. 1 and is generally indicated by the reference numeral 20.

The housing nut 21 of the illustrated injector is threaded to and is an extension of the injector body 30. The nut extends from the body, which is at the exterior of the engine, through the engine wall to the combustion chamber. The housing nut houses most of the stacked injector components that are described below, and threadedly clamps them in their stacked relationship.

In a well-known manner, the injector is clamped in the engine wall by an injector hold-down crab or clamp (not shown) which engages the hold-down stud 42. The locator pin 44 further defines orientation of the injector in clamped position.

The drive linkage that powers the injector pump plunger 1 includes the rocker arm assembly associated with the rocker arm 27. This linkage actuates the plunger as determined by the engine cam profile. This linkage includes (i) the associated engine cam 32 having a base circle 33, (ii) the rocker arm proper 27, the cam follower 34 at the input end of the arm, and the adjusting screw 28 at the output end, (iii) a "button" or socket pad 36 on the head of the adjusting screw and forming, together with the head, a ball-and-socket joint, and (iv) the spring-loaded tappet or follower 24 carried by the injector body and whose top flat face 25 is slidably engaged by the pad 36 in a manner to accommodate the slight variance between the rocking motion of the adjusting screw and pad and the strictly rectilinear motion of the tappet.

The pump plunger and tappet are linked together by the illustrated knob-and-slot arrangement. The tappet and plunger are linked together for axial movement together by the illustrated knob-and-slot arrangement.

As the plunger advances downwardly in a feed stroke, compressive loads are transmitted through the interface between the top face 38 of the plunger knob 37 and the adjacent under-face of the tappet 24.

During operation of the injector, when the upper control edge 17 of the descending plunger 1 completely covers the fill port 2 in the bushing 4, a pressure wave is generated in the pump chamber 23 (which is connected through a plunger-stem internal passage, not shown, to the chamber defined between the control edges 16 and 17). The pressure wave travels past the check valve 12, through the fuel ducts in the check valve cage 6 and through the fuel ducts 9 in the spring cage 8, into the fuel ducts 13 of the nozzle body 10, and into the cavity 14 where the pressure wave acts on the conical differential area of the nozzle valve 11 to lift the valve off the body seat against the bias of the coil spring 22, also referred to as the valve spring, and injection begins.

The valve stays lifted during the time fuel is being delivered by the plunger 1 to the nozzle. When the lower control edge 16 uncovers the spill port 3 in the bushing 4, the pressure in the pump chamber 23 drops to fluid-supply pressure and the check valve 12 in the valve cage 6 seats on the plate 18, sealing the fuel transport duct 19. As these events occur, the pressure in the nozzle fuel chamber 14 then drops rapidly; when it drops to the valve-closing pressure, the valve closes and injection ends for that stroke of the plunger.

The plunger 1 and bushing 4 together form a plunger-and-bushing assembly which controls the delivery of fuel. The bushing 4 is fixed and the plunger moves axially within the bushing in a downward feed stroke and an upward return stroke. In a well known manner, the angular position of the plunger relative to the fixed bushing 4 is also changed through a range by a control rack (not shown) to control the amount of fuel delivered with each feed stroke of the plunger 1 by varying the distances into the stroke at which the fixed fill and spill ports 2 and 3 formed in the bushing 4 are closed and opened by the working portions of the upper and lower control edges 17 and 16. The range of control-rack-imposed angular positions of the plunger progress through a range of load settings from high to idle or lowest.

Each point along the working portions of the control edges is located a certain distance along the length-of the plunger, that is, a certain vertical distance from the tappet-engaging top face 38 of the plunger knob 37 at the top end of the plunger. As to each point on the upper control edge 17, this distance may be referred to as the point's "timing distance along the plunger," since the magnitude of such distance determines at what desired number of crank degrees of an associated engine piston the associated control edge will complete the closing of the bushing port 2 when the point crosses that port as the plunger advances, assuming that the tappet 24 is a standard tappet having a standard effective length (the length from the tappet's top face 25 to the tappet's interface with the top face 38 of the plunger knob 37), and further assuming, of course, that any significant wear in the linkage comprising the rocker arm 27 and associated elements has been compensated for by properly resetting the adjusting screw 28 and securing it with the lock nut 29.

If tappets are made and used whose effective length is increased or decreased from standard, then the distance between each point on the control edge 17 and the knob top face 38 must be correspondingly decreased or increased from what it was so that the sum of (1) each edge point's new "timing distance along the plunger" and (2) the effective length of the new tappet will remain the same as what the corresponding sum was when a standard tappet was employed. In this circumstance "timing distance along the plunger" is to be understood to refer to the new distance between each point and the top face of the plunger knob. The making and using of such modified tappets is disadvantageous in that it involves the modification of two parts (plunger and tappet) of the injector assembly, rather than simply modification of the plunger alone.

Control edges are generally helical in shape, and the angle of an edge to the horizontal is often referred to as the helix angle of the edge. The steeper the slope of the helix, i.e., the greater its helix-angle, the greater the change in timing from one power setting to the next in either the retarding or advancing direction, depending on whether the slope is negative or positive in direction. If the working part of a control edge has no slope, it may be referred to as having a helix angle of zero.

Figure 3:
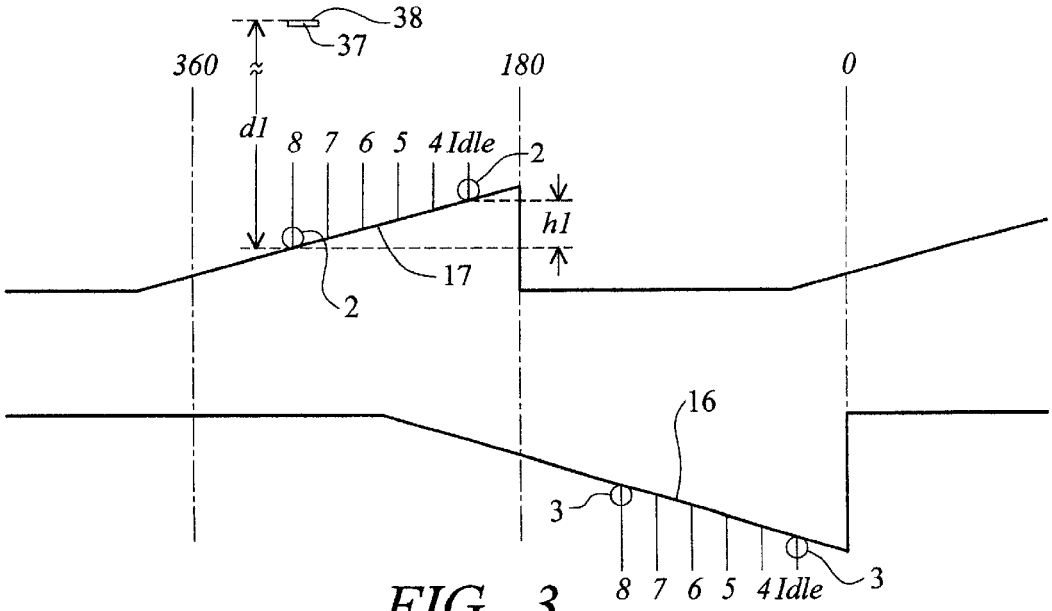
FIG. 3 (Prior Art)
FIG. 3 is a planar development view or diagram of the control edges of the plunger of FIG. 1, showing the plunger's control edges around their 360 degree annular extent, and also showing, for two different load settings, the position, at cut-off, of the injector's fill port relative to the fill port's associated control edge, and the position, at spill, of the injector's spill port relative to the spill port's associated control edge.

As indicated above, the plunger 1 seen in FIG. 1 and diagramed in FIG. 3 is of standard design. In their working portions, the upper and lower control edges 17 and 16 are helical edges of constant and opposite slopes. The upper edge 17 has a slope greater than that of the lower edge. In FIG. 3, notch positions from Notch 8 (full load) to Idle are indicated by vertical lines. The position at port closing (fill) of the upper port 2 relative to the upper control edge 17 is indicated for Notch 8 position and for Idle position. Also, the position, at port opening (spill), of the lower port. 3 relative to the lower control edge 16 is indicated for Notch 8 position and for Idle position.

As the control edges are viewed in FIG. 3, at any point on the working portions of the control edge 17, the higher the point, the greater the retardation in timing of port closing. Since the point on the curve at which cut-off of port 2 occurs at Idle is above the point on the curve at which cut-off of port 2 occurs at Notch 8, cut-off at Idle is retarded from cut-off at Notch 8. Thus the timing of cut-off changes, in the retarding direction, from full load setting (Notch 8 position in this-case) down to the lowest setting (Idle in this case). This change occurs in a straight-line manner because the slope of the edge 17 is constant across all settings. In other words, the degree of retardation at cut-off is a straight-line function of the angular (rotative) position of the plunger relative to the bushing along the working range of the cut-off edge.

The amount of this retardation of cut-off at Idle from cut-off at Notch 8 is shown in FIG. 3 as the distance h1 for the illustrated standard plunger. This distance corresponds to some certain difference in instantaneous angular positions, expressed in crank degrees, of the piston. Also, the timing distance associated with port closing by the top control edge at full load setting is the distance d1 between the edge point that is identified with completion of closing (i.e., the point of tangency between the control edge and the port 2 that momentarily exists as the edge completes the closing of the port) and the top face 38 of the plunger knob 37. This distance corresponds to some certain instantaneous angular position, expressed in crank degrees, of the piston.

The vertical distance between the then-active points on the upper and lower control edges 17 and 16 at any angular position of the plunger (such active points typically being 180 degrees removed from each other because the ports 2 and 3 typically are on opposite sides of the bushing 4) determines the injector fuel output at that position. Accordingly, throughout the working ranges of the control edges, the lower control edge 16 is spaced such distance below the upper control edge at each angular position of the plunger as is necessary to provide the desired fuel output at that position. This function determines the shape of the lower edge 16.

Figure 4:
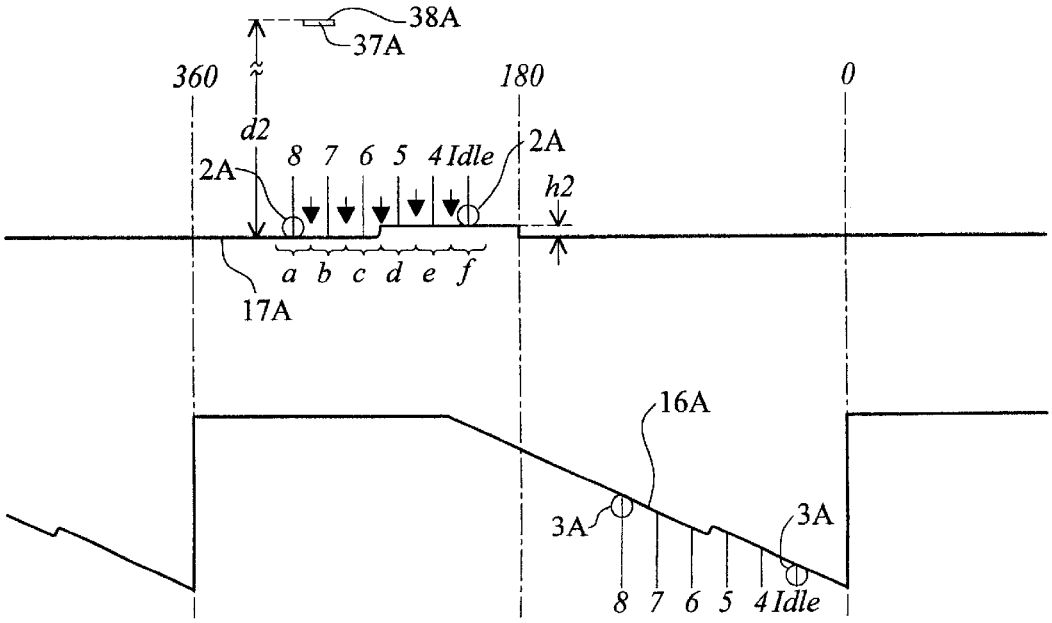
FIG. 4 is a view similar to FIG. 3 but showing the control edges and fill and spill ports of the substitute plunger of FIG. 2.

One form of plunger contemplated by the invention is shown in FIGS. 2 and 4. In FIG. 2, the plunger 1A is shown substituted for the standard plunger 1 in an otherwise standard injector having a standard bushing (here labeled 4A) identical to bushing 4, and whose fill port 2A and spill port 3A are arranged in the same manner as fill port 2 and spill port 3. FIG. 4 shows a planar development of the upper and lower control edges 17A and 16A of the plunger 1A. Similarly to the scheme of presentation in FIG. 3, FIG. 4 indicates the position, at port closing, of the upper port 2A relative to the upper control edge 17A for both full power (Notch 8) position and for the lowest (Idle) position. Also, the position, at port opening (spill), of the lower port 3A relative to the lower control edge 16A is indicated for both the Notch 8 position and for the Idle position.

As can be seen in FIG. 4, in plunger 1A, timing of closing again increases in the retarding direction (but in a non-straight-line manner) from highest power (Notch 8) position to lowest power (Idle) position. However, the amount of this retardation, shown in FIG. 4 as the distance h2, is less than the distance hi shown in FIG. 3. (Also, all of the retardation occurs between Notch 6 and Notch 5 positions in this particular plunger 1A.) As did the distance h1, the distance h2 again corresponds to some certain difference in instantaneous angular positions, expressed in crank degrees, of the piston. Also, the timing distance associated with port closing by the top control edge 17A at full load setting is a certain distance d2 between the edge point that is identified with completion of closing (i.e., the point of tangency between the control edge and the port 2A that momentarily exists as the edge completes the closing of the port) and the top face 38A of the associated plunger knob 37A. Again, as did distance d1 in FIG. 3, this distance d2 corresponds to some certain angular position, expressed in crank degrees, of the piston.

The difference between the timing distance d1 associated with plunger 1 and the timing distance d2 associated with plunger 1A is equivalent to several crank degrees, with distance d2 being less than distance d1. That is, the timing of closing at full load setting of the plunger 1A is retarded from the timing of closing at full load setting of the standard or reference plunger 1 by the amount (d1–d2).

The upper control edge 17A of plunger 1A can be described as comprising a series of adjacent edge segments, a to f, each of 0 degrees helix angle. Each edge segment in this series is joined to each neighboring segment at a common boundary region midway between the segment and each of the one or two edge segments that neighbor it. In FIG. 4, such common boundary regions on the upper control edge 17A are indicated by solid-headed, down-pointing arrows.

Each of the edge segments a to f is associated with its own one of a corresponding series of rotative positions of the plunger so as to be rotatively centered on the fill port 2A and to angularly extend a distance to each side of the fill port at such associated rotative position. Each rotative position in such series of rotative positions corresponds to one of the series of load settings progressing from full load (Notch 8) setting to lowest (Idle) setting. For example, segment a is associated with the rotative position of the plunger corresponding to the full load (Notch 8) setting, so as to be rotatively centered on the fill port 2A at that rotative position. Segment b is similarly associated with the rotative position corresponding to the Notch 7 setting, segment c with the plunger rotative position corresponding to the Notch 6 setting, and so forth.

More generally, there is a one-to-one correspondence between the segments a to f and the Notch 8 to Idle settings, each segment being brought into play, so to speak, at its own corresponding power setting.

Each of the segments a to f has an associated timing distance which may be the same or different than that of other segments. For example, in the plunger 1A, the timing distance d2 applies to segments a, b and c, and a slightly smaller distance applies to segments d, e and f. In plunger 1A, the adjacent pair of segments c and d have different timing distances and form a step. The riser of this step joins them at their common boundary region, the height of the riser being equal to the difference between their respective associated timing distances.

The shape of the lower control edge 16A is determined by shaping it to provide the same fuel output at each angular position of the plunger as a reference standard plunger provides at that position. This is done by providing the same vertical distance between the then-active points on the upper and lower control edges 17A and 16A at each angular position as the reference standard plunger provides between the active points on its upper and lower control edges at the same angular position.

Figure 5:
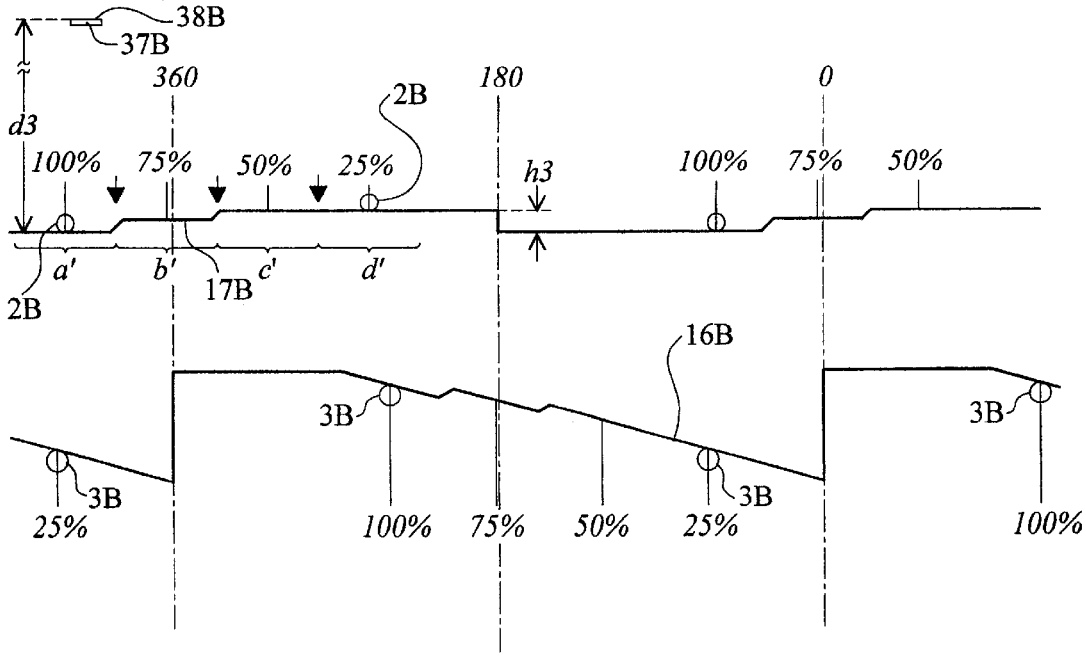

The plunger of FIG. 4 is one of a family of possible plungers contemplated by the invention in which segments of 0 degrees helix angle similarly have a one-to-one correspondence to a series of power settings and there are one or more steps between adjacent segment pairs. Another example is shown in FIG. 5, which shows control edges of another plunger (the plunger itself is not shown in the drawings, nor is the bushing in which it moves). Here the one-for-one correspondence is between the series of power settings 100%, 75%, 50% and 25% and the series of edge segments a', b'. c' and d'. Again, as they were in FIG. 4, the locations of boundary regions between segments are indicated by solid-headed, down-pointing arrows. Here there are two steps, one at the boundary region between segments a' and b', and another at the boundary between segments b' and c'. Similarly to the scheme of presentation in FIGS. 3 and 4, FIG. 5 indicates the position, at port closing, of the upper port 2B relative to the upper control edge 17B for both the full power (100%) position and the lowest (25%) position. Also, the position, at port opening (spill), of the lower port 3B relative to the lower control edge 16B is indicated for both the 100% position and the 25% position.

In the plunger of FIG. 5, timing, from highest power position (100%) to lowest power position (25%) changes .in the retarding direction by the amount h3, which again, like distance h2 in FIG. 4, is less than the distance h1 shown in FIG. 3. Also, the timing distance associated with port closing by the top control edge 17B is a certain distance d3 between the edge point that is identified with the completion of closing and the top face 38B of the associated plunger knob 37B. Again, like distance d2 shown in FIG. 4, the distance d3 is less than the distance d1 associated with the standard plunger 1 shown in FIG. 3. Again, as in the plungers earlier referred to, the shape of the control lower edge, edge 16B in this case, is determined by shaping it to provide the same fuel output at each angular position of the plunger as a reference standard plunger provides at that position.

According to one important aspect of the invention, plungers of designs such as the ones just described can constitute replacement plungers customized to an EMD-type engine having a given mix of characteristics, or in such a way as to improve overall emissions/fuel-economy performance of engines with that mix of characteristics when the standard model's injector plungers are replaced with plungers of new design. Using a standard plunger for the injector of the particular model of EMD engine as a reference, plunger, designs such as the ones just described can be the product of subjecting prototype plungers to a pre-established routine as follows:

In the first step, a set of prototype replacement plungers is provided each having a port-closing control edge shaped such that the timing of closing at highest load setting is retarded from the timing of closing at highest load setting of the reference standard plunger. The amount of this retardation is determined by first determining the amount of retardation of a standard plunger's upper control edge at full load setting that optimizes emissions/fuel-economy of the plunger at the full-load setting, and then using the equivalent timing distance as the exact or approximate timing distance for the control edge 17A at full-load port closing. In many instances, the-amount of this retardation will be within the range of 3 to 5 degrees of crank angle.

In this step of providing prototype plungers, each plunger's port-closing control edge is also shaped such that the timing of closing changes in the retarding direction from the highest load setting down to the lowest, but by an amount substantially less that the amount by which the timing of closing changes in the retarding direction in the reference standard plunger. This change in the retarding direction in the prototype replacement plunger is preferably accomplished by providing one or two steps at the boundary regions between pairs of adjacent control edge segments of 0 degrees helix angle, similarly to what the plungers of FIGS. 4 and 5 do, the choice of the pair or pairs of adjacent sectors and the height of the step riser or risers being based on best informed judgment.

This step of providing prototype plungers is performed by making them, or, by simply choosing them from an inventory of plungers if ones can be identified that meet the foregoing criteria, as may be so, particularly if accumulation of a considerable inventory of prototype plungers with various edge shapes has resulted from practice of the method over time.

The next step is an assessing step. The emissions/fuel-economy performance of the most recently provided set of prototype replacement plungers, which may be the first-provided set or a later-made set, is assessed at each load setting and all load settings. The plungers are substituted in the injectors of the reference standard EMD engine model, the injectors are calibrated, the engine is operated, and the emissions/fuel-economy performance observed and recorded.

The next step is selecting a new pattern of timings of closing associated with the various load settings. The new pattern reflects, or continues to reflect, a change in the retarding direction in a non-straight-line manner from the highest to the lowest load setting. The new pattern is modified from the pattern of timings of closing associated with the most recently made set of prototype replacement plungers such that, at each setting, the direction and amount of timing adjustment, if any, are indicated to contribute to improved rating of overall emissions/fuel economy over all load settings, taking into account regulatory weightings associated with each load setting.

This step includes compromising between tentatively indicated timings associated with a given pair of adjacent load-setting positions if the difference in such indicated timings is relatively small compared to a difference or differences in indicated timing between another pair or other pairs of adjacent load setting positions, such compromise consisting of selecting for both members of such given pair a timing between such tentatively indicated timings, thereby taking into account that avoidance of change of timing between adjacent load settings contributes positively to fuel economy.

It is to be noted in connection with this selecting step that an advantage of providing segmented edges of 0 degrees helix angle, similarly to what the plungers of FIGS. 4 and 5 do, is that the timing distance associated with any edge segment (and its corresponding load setting position) may be adjusted by raising or lowering that segment's location along the length of the plunger without affecting the timing of any other edge segment or segments, and thus a pattern of quantified desired changes of timing indicated by test results, including such changes of zero amount as may be indicated, can be straightforwardly identified segment by segment and correspondingly mapped segment by segment onto an intended new prototype replacement plunger. With a standard plunger, for example, or with other plungers whose upper or cut-off edges do not comprise a series of adjacent edge segments of 0 degrees helix angle, this selecting step is relatively difficult to perform, since changing the timing associated with one segment tends to affect the timings associated with other segments.

The next step is making a new set of prototype replacement plungers each of whose pattern of timings associated with all the various load settings conforms to the most recent new selected pattern, and repeating the assessing step.

Then, the steps of selecting, making and assessing are repeated as required until an assessment indicates compliance of the newest prototype plunger with applicable performance standards.

Thereafter, the complying prototypes may be used as replacement plungers for use in the engine on which they were tested, or in another EMD engine of the same model, the same model series letter, the same application i.e., locomotive, marine, or power generation, and the same mix of characteristics, such as engine rpm at top rating, combustion chamber shape, use or non-use of turbocharging (and type of supercharging if used, i.e., whether exhaust driven or Roots blowered), use with generators as against alternators or vice versa, and other variable attributes that may be encountered. If there is a question about differences between an engine that is a candidate for performance improvement and another reference engine that has already been improved, the method of the invention may be employed to accomplish the performance improvement of the candidate engine. Depending on the extent of the differences between the characteristics of the two engines, plungers of the same configuration as those made for the reference engine may be a plausible choice to use as the starting prototype plungers.

The invention is not to be limited to details of the above disclosure, which are given by way of example and not by way of limitation. Many refinements, changes and additions are possible, as should be evident to those familiar with the art.

What is claimed is:

1. A plunger to be used in the plunger-and-bushing assembly of an EMD type injector for an EMD type diesel engine, said plunger having a port-closing edge associated with the fill port of the bushing and a spill edge associated with the spill port of the bushing, said fill and spill ports being separate from each other, said port-closing edge comprising a series of adjacent edge segments each of 0 degrees helix angle, each edge segment in said series being joined to each neighboring segment at a common boundary region between said each edge segment and each of the one or two edge segments that neighbor it, each of said edge segments in said series being associated with its own one of a corresponding series of rotative positions of said plunger so as to be rotatively centered on said fill port and to angularly extend a distance to each side of the fill port at said associated rotative position, each rotative position in said series of rotative positions corresponding to one of a series of load settings progressing from full load position to lowest position, each of said edge segments being located at an associated timing distance along the length of the plunger to thereby establish for that segment an associated timing of fill-port closing relative to crank degrees of an associated engine piston, the members of one or more adjacent pairs of said edge segments having different associated timing distances, such members forming a step and being joined by a step riser at their common boundary region, the height of said riser being equal to the difference between their respective associated timing distances.

2. A plunger to be used in the plunger-and-bushing assembly of an EMD type injector for an EMD type diesel engine, said plunger having a port-closing edge associated with the fill port of the bushing and a spill edge associated with the spill port of the bushing, said port-closing edge comprising a series of adjacent edge segments each of 0 degrees helix angle, each edge segment in said series being joined to each neighboring segment at a common boundary region between said each edge segment and each of the one or two edge segments that neighbor it, each of said edge segments in said series being associated with its own one of a corresponding series of rotative positions of said plunger so as to be rotatively centered on said fill port and to angularly extend a distance to each side of the fill port at said associated rotative position, each rotative position in said series of rotative positions corresponding to one of a series of load settings progressing from full load position to lowest position, each of said edge segments being located at an associated timing distance along the length of the plunger to thereby establish for that segment an associated timing of fill-port closing relative to crank degrees of an associated engine piston, the members of one or more adjacent pairs of said edge segments having different associated timing distances, such members forming a step and being joined by a step riser at their common boundary region, the height of said riser being equal to the difference between their respective associated timing distances, the number of steps formed in said part-closing edge being between one and a second number that is two less than the number of load settings.

3. A plunger to be used in the plunger-and-bushing assembly of an EMD type injector for an EMD type diesel engine, said plunger having a port-closing edge associated with the fill port of the bushing and a spill edge associated with the spill port of the bushing, said port-closing edge comprising a series of adjacent edge segments each of 0 degrees helix angle, each edge segment in said series being joined to each neighboring segment at a common boundary region between said each edge segment and each of the one or two edge segments that neighbor it, each of said edge segments in said series being associated with its own one of a corresponding series of rotative positions of said plunger so as to be rotatively centered on said fill port and to angularly extend a distance to each side of the fill port at said associated rotative position, each rotative position in said series of rotative positions corresponding to one of a series of load settings progressing from full load position to lowest position, each of said edge segments being located at an associated timing distance along the length of the plunger to thereby establish for that segment an associated timing of fill-port closing relative to crank degrees of an associated engine piston, the members of one or more adjacent pairs of said edge segments having different associated timing distances, such members forming a step and being joined by a step riser at their common boundary region, the height of said riser being equal to the difference between their respective associated timing distances, the timing distance of the edge segment associated with the highest load setting corresponding to about a 3 to 5 degree retardation from the timing of the helix edge associated with the highest load setting in a standard plunger for said EMD type injector.

4. A plunger to be used in the plunger-and-bushing assembly of an EMD type injector for an EMD type diesel engine, said plunger having a port-closing edge associated with the fill port of the bushing and a spill edge associated with the spill port of the bushing, said port-closing edge comprising a series of adjacent edge segments each of 0 degrees helix angle, each edge segment in said series being joined to each neighboring segment at a common boundary region between said each edge segment and each of the one or two edge segments that neighbor it, each of said edge segments in said series being associated with its own one of a corresponding series of rotative positions of said plunger so as to be rotatively centered on said fill port and to angularly extend a distance to each side of the fill port at said associated rotative position, each rotative position in said series of rotative positions corresponding to one of a series of load settings progressing from full load position to lowest position, each of said edge segments being located at an associated timing distance along the length of the plunger to thereby establish for that segment an associated timing of fill-port closing relative to crank degrees of an associated engine piston, the members of one or more adjacent pairs of said edge segments having different associated timing distances, such members forming a step and being joined by a step riser at their common boundary region, the height of said riser being equal to the difference between their respective associated timing distances, the number of steps formed in said port-closing edge being between one and a second number that is two less than the number of load settings, the timing distance of the edge segment associated with the highest load setting corresponding to about a 3 to 5 degree retardation from the timing of the helix edge associated with the highest load setting in a standard plunger for said EMD type injector.

5. An EMD-type unit injector having a plunger-and-bushing assembly in which the plunger is a plunger as set forth in claim 1.

6. An EMD-type diesel engine having for each of its cylinders an injector as set forth in claim 5.

7. A method of improving overall emissions/fuel economy performance of an EMD turbocharged diesel engine of a given model and application, using as a reference a set of standard EMD unit injectors for that EMD model, said reference standard EMD injectors each having an associated reference standard plunger, comprising the steps of:

providing a set of prototype replacement plungers each having a port-closing edge located and shaped such that there is provided at each load setting a given associated timing of fill-port closing corresponding to a given number of crank degrees of an associated engine piston, and such that the timing of closing changes in the retarding direction from the full-load setting down to the idle setting by an amount less than the amount by which the timing of closing changes in the retarding direction in said reference standard plungers, and such that the timing of closing at full load setting is retarded from the timing of closing at full-load setting of said reference standard plungers by an amount determined by first determining the amount of retardation of a standard plunger's upper control edge at full load setting that optimizes emissions/fuel-economy of the plunger at the full-load setting, and then using the equivalent timing distance as the exact or approximate timing distance for the control edge 17A at full-load port closing, assessing, at each load setting and over all load settings, the emissions/fuel economy performance associated with the most recently provided set of prototype replacement plungers when installed and operated in said reference standard injectors, selecting a new pattern of timings of closing associated with the various load settings, said new pattern being such that the timing of closing will reflect a change, in the retarding direction, in a non-straight-line manner from the full load setting down to the lowest setting, said new pattern being modified from the pattern of timings of closing associated with said most recently made set of prototype replacement plungers such that at each load setting the direction and amount of timing adjustment, if any, are indicated to contribute to improved rating of overall emissions/fuel-economy over all load settings, taking into account regulatory weightings associated with each load setting, said selecting step including compromising between tentatively indicated timings associated with a given pair of adjacent load-setting positions if the difference in such indicated timings is relatively small compared to a difference or differences in indicated timing between another pair or other pairs of adjacent load setting positions, such compromise consisting of selecting for both members of such given pair a timing between such tentatively indicated timings, thereby taking into account that avoidance of change of timing between adjacent load settings contributes positively to fuel economy, making a new set of prototype replacement plungers each of whose pattern of timings associated with all the various load settings conforms to the most recent said new selected pattern, and repeating said assessing step, and then repeating said steps of selecting, making and assessing if and as required until an assessment indicates compliance of the newest prototype plunger with applicable performance standards, and using replacement plungers having the form of the complying prototype in injectors for said engine of said given model and application.

8. A method as in claim 7, said first step of providing a set of prototype replacement plungers including providing such plungers such that the upper control edge of each plunger comprises a series of adjacent edge segments each of 0 degrees helix angle.

* * * * *